US008919920B2

(12) United States Patent
Suzuki

(10) Patent No.: US 8,919,920 B2
(45) Date of Patent: Dec. 30, 2014

(54) IMAGE FORMING APPARATUS

(71) Applicant: Canon Kabushiki Kaisha, Tokyo (JP)

(72) Inventor: Hiroshi Suzuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/019,818

(22) Filed: Sep. 6, 2013

(65) Prior Publication Data

US 2014/0078208 A1 Mar. 20, 2014

(30) Foreign Application Priority Data

Sep. 14, 2012 (JP) ..... 2012-202615

(51) Int. Cl.

| | |
|---|---|
| ***B41J 11/42*** | (2006.01) |
| ***B41J 13/02*** | (2006.01) |
| ***B41J 23/12*** | (2006.01) |
| ***B41J 13/10*** | (2006.01) |
| ***B41J 2/165*** | (2006.01) |
| ***B41J 23/02*** | (2006.01) |
| ***B41J 13/03*** | (2006.01) |

(52) U.S. Cl.

CPC *B41J 23/12* (2013.01); *B41J 13/02* (2013.01); *B41J 13/106* (2013.01); *B41J 2/165* (2013.01); *B41J 23/025* (2013.01); *B41J 13/03* (2013.01)

USPC ..... 347/32; 347/16; 347/104

(58) Field of Classification Search

USPC ..... 347/16, 104, 32

See application file for complete search history.

(56) References Cited

U.S. PATENT DOCUMENTS

| | | | | |
|---|---|---|---|---|
| 6,869,241 | B2 * | 3/2005 | Ouchi et al. | 400/578 |
| 7,976,020 | B2 | 7/2011 | Awai | |
| 2009/0009541 | A1 * | 1/2009 | Shimazaki | 347/6 |

FOREIGN PATENT DOCUMENTS

JP 2010-006608 A 1/2010

* cited by examiner

*Primary Examiner* — Julian Huffman
*Assistant Examiner* — Sharon A Polk
(74) *Attorney, Agent, or Firm* — Fitzpatrick, Cella, Harper & Scinto

(57) ABSTRACT

There is provided an image forming apparatus in which a waiting time is small and the throughput is not degraded. Therefore it is determined whether or not a delay accumulation operation is necessary at the time of performing a cap closing operation or a wiping operation. If necessary, the delay accumulation operation is performed.

4 Claims, 12 Drawing Sheets

IMAGE FORMING APPARATUS

BACKGROUND OF THE INVENTION

1. Field of the Invention

The present invention relates to an image forming apparatus that is provided with a sheet discharge roller for discharging a sheet material, a sheet discharge tray that is attached to an apparatus main body to be openable and closable thereto and holds the sheet material discharged from the sheet discharge roller, and a recovery unit that is driven in association with the sheet discharge roller.

2. Description of the Related Art

A sheet discharge tray of a typical printing apparatus is configured to be openable and closable around its rotary shaft. This sheet discharge tray is retained in a closed state at the time it is not used, whereby the apparatus can be made to be compact and the entering of dusts and the like into a print unit can be prevented. However, when a print starts in a state where the sheet discharge tray is closed, in some cases there occurs a problem that discharge of the printed sheet material is interrupted by the sheet discharge tray to cause a sheet jam in the apparatus. For overcoming this problem, there is proposed the invention that, when the sheet material is conveyed, the sheet discharge tray is automatically made to be in an open state.

Japanese Patent Laid-Open No. 2010-6608 discloses a printing apparatus comprising a sheet discharge roller for discharging sheet materials, a sheet discharge tray attached to an apparatus main body to be openable and closable thereto for holding the sheet material discharged by the sheet discharge roller, a delay mechanism formed of a plurality of ring members to be rotatable with delay in synchronization with the sheet discharge roller, and a control mechanism formed of a plurality of link members and a plurality of flexible members. Japanese Patent Laid-Open No. 2010-6608 proposes the printing apparatus in which the delay mechanism is provided with a plurality of cam units rotatable with the plurality of the ring members, and a phase control unit for controlling phases of the plurality of the cam units, wherein one link member in the control mechanism is connected to the sheet discharge tray, and when the phases of the plurality of the cam units are in agreement, the sheet discharge tray is opened through the control mechanism by a drive of the sheet discharge roller.

In the delay mechanism of Japanese Patent Laid-Open No. 2010-6608, a predetermined amount of the delay can be accumulated by rotating the sheet discharge roller in a reverse direction to a sheet discharge direction. That is, with the configuration that the sheet discharge roller and a suction pump of a print agent are driven with the same drive source, the pump performs a suction operation in association with the backward rotation of the sheet discharge roller, and a pump initializing operation is performed in association with the forward rotation of the sheet discharge roller, wherein the delay amount is in advance accumulated and the pump is initialized by a drive amount within the delay amount. This can prevent an inadvertent sheet discharge tray opening operation other than at sheet-discharging. The configuration that the sheet discharge tray automatically opens before sheet-discharging is an effective function for preventing a problem such as a sheet jam inside the apparatus. On the other hand, since it is not preferable that the sheet discharge tray inadvertently opens regardless of no schedule of sheet-discharging, such as in a case where a user finishes a print and disconnects a power source of the printing apparatus, it is necessary to perform a delay accumulation operation for preventing the inadvertent sheet discharge tray opening operation.

Recently for the purpose of cost reduction, there is proposed an apparatus configuration that not only the sheet discharge roller and the suction pump, but also a set of a recovery mechanism for performing a recovery operation that makes a state of the print unit good are driven by the same drive source. The recovery operation of the print unit is performed at various timings. The recovery operation is regularly configured of complicated sequence, such as wiping and capping operations, which causes many drive amounts of the recovery mechanism. Therefore in a case of the configuration where the sheet discharge roller rotates in the sheet discharge direction in association with a drive of the recovery mechanism, it is required to perform the delay accumulation operations many times in the middle of the recovery operation for preventing the inadvertent sheet discharge tray opening operation. However, since it takes time to perform the delay accumulation operation, there is a problem that a time (waiting time) for which a user has to wait by the recovery operation is made longer to degrade throughput.

SUMMARY OF THE INVENTION

Therefore the present invention has an object of providing an image forming apparatus in which a waiting time for a user is small and the throughput is not degraded.

Therefore an image forming apparatus according to the present invention comprises a print unit configured to perform a print on a print medium by ejecting ink from a print head, a sheet discharge unit configured to discharge the print medium on which the print is performed with rotation of a sheet discharge roller, a recovery unit configured to recover an ejection state of the print head, a drive unit configured to drive the sheet discharge roller and the recovery unit, and a control unit configured to control the drive of the drive unit, wherein the sheet discharge tray performs an opening operation with transmission of the drive at a forward rotation of the sheet discharge roller, and performs the opening operation with the forward rotation of the sheet discharge roller exceeding a delay amount accumulated in a delay accumulation mechanism by a delay accumulation operation caused by a backward rotation of the sheet discharge roller, wherein the control unit comprises a determining unit configured to determine whether or not the delay accumulation operation is performed, wherein in a case where the determining unit determines that the delay accumulation operation is performed, the delay accumulation operation is performed at the time the recovery unit performs the recovery operation.

According to the present invention, the image forming apparatus is provided with the determining unit configured to determine whether or not the delay accumulation operation is performed, wherein in a case where the determining unit determines that the delay accumulation operation is performed, the delay accumulation operation is performed at the time the recovery unit performs the recovery operation. This can realize the image forming apparatus in which the waiting time for a user is small and the throughput is not degraded.

Further features of the present invention will become apparent from the following description of exemplary embodiments (with reference to the attached drawings).

DESCRIPTION OF THE EMBODIMENTS

First Embodiment

Figure 1:
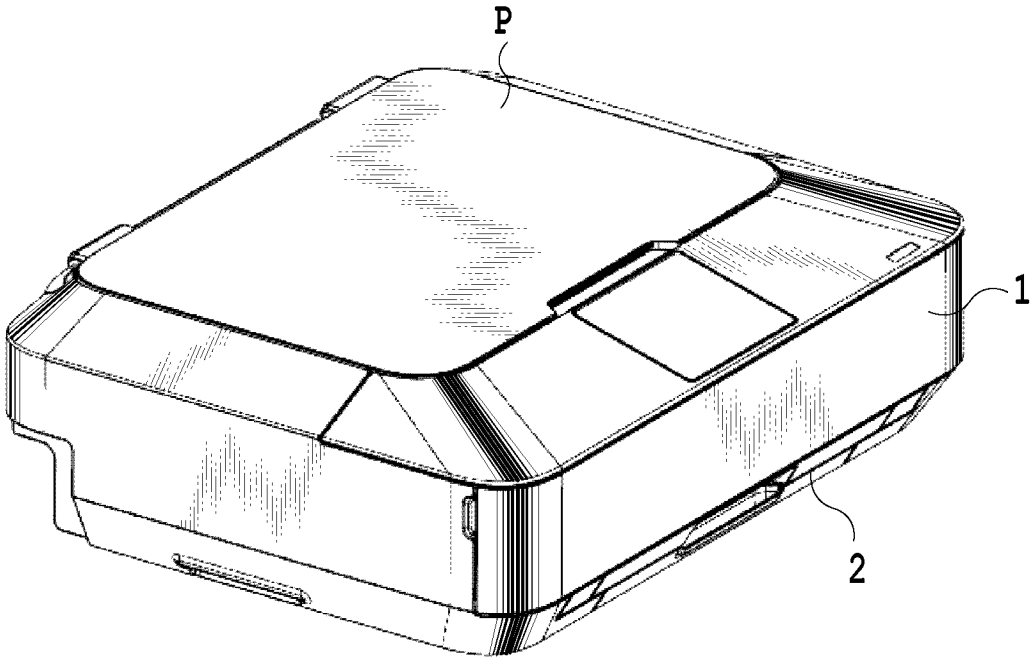
FIG. 1 is a perspective view of a main body in an image forming apparatus according to the present embodiment.
Figure 2:
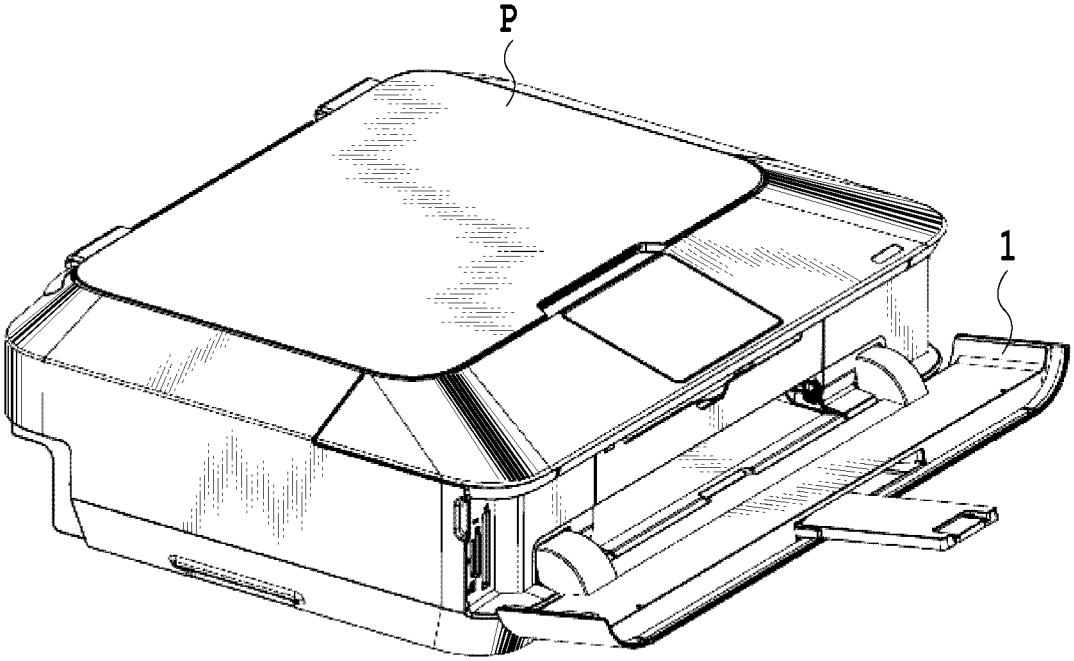
FIG. 2 is a perspective view of the main body in the image forming apparatus according to the present embodiment.

Hereinafter, a first embodiment in the present invention will be explained with reference to the accompanying drawings. First an explanation will be made of an entire configuration of an image forming apparatus according to the present embodiment. FIG. 1 and FIG. 2 are perspective views each showing a main body of an image forming apparatus P according to the present embodiment. The image forming apparatus P is provided therein with a sheet stacking unit 2, a sheet conveying unit, a sheet feeding unit, print heads provided in a print unit, ink tanks, a carriage on which the print heads and the ink tanks are mounted and that reciprocates in a direction vertical to a sheet conveying direction, a recovery unit, a control unit, and a sheet discharge unit. The image forming apparatus P is further provided with a carriage motor for driving the carriage, a conveying motor for driving the sheet discharge unit, a control substrate, and the like. The sheet discharge unit is provided with a sheet discharge roller, a sheet discharge tray 1, and the like.

Figure 3:
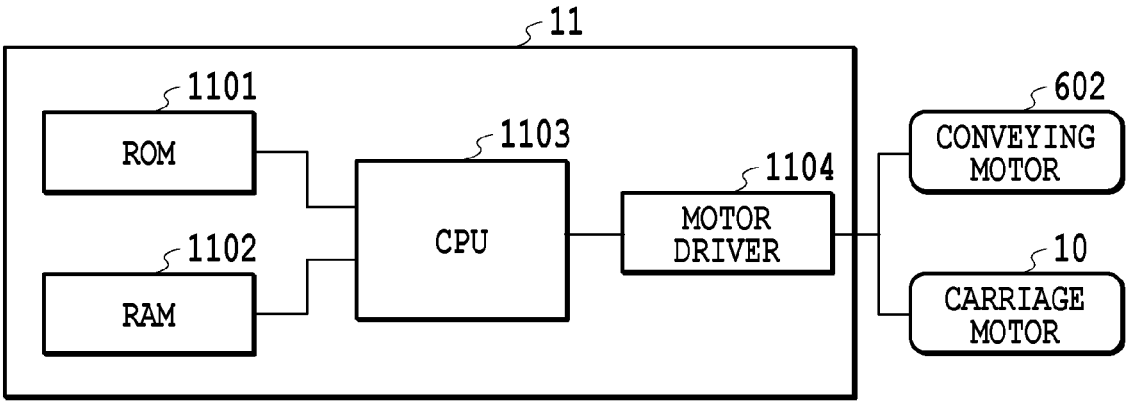
FIG. 3 is a diagram showing the configuration of a control substrate.

FIG. 3 is a diagram showing the configuration of a control substrate 11. The control substrate 11 includes a ROM 1101 for storing a drive profile and a parameter of each motor, a RAM 1102 for storing a temporal constant, and a CPU 1103 for performing a control calculation. The CPU 1103 performs drive control of a carriage motor 10 and a conveying motor 602 through a motor driver 1104.

Figure 4:
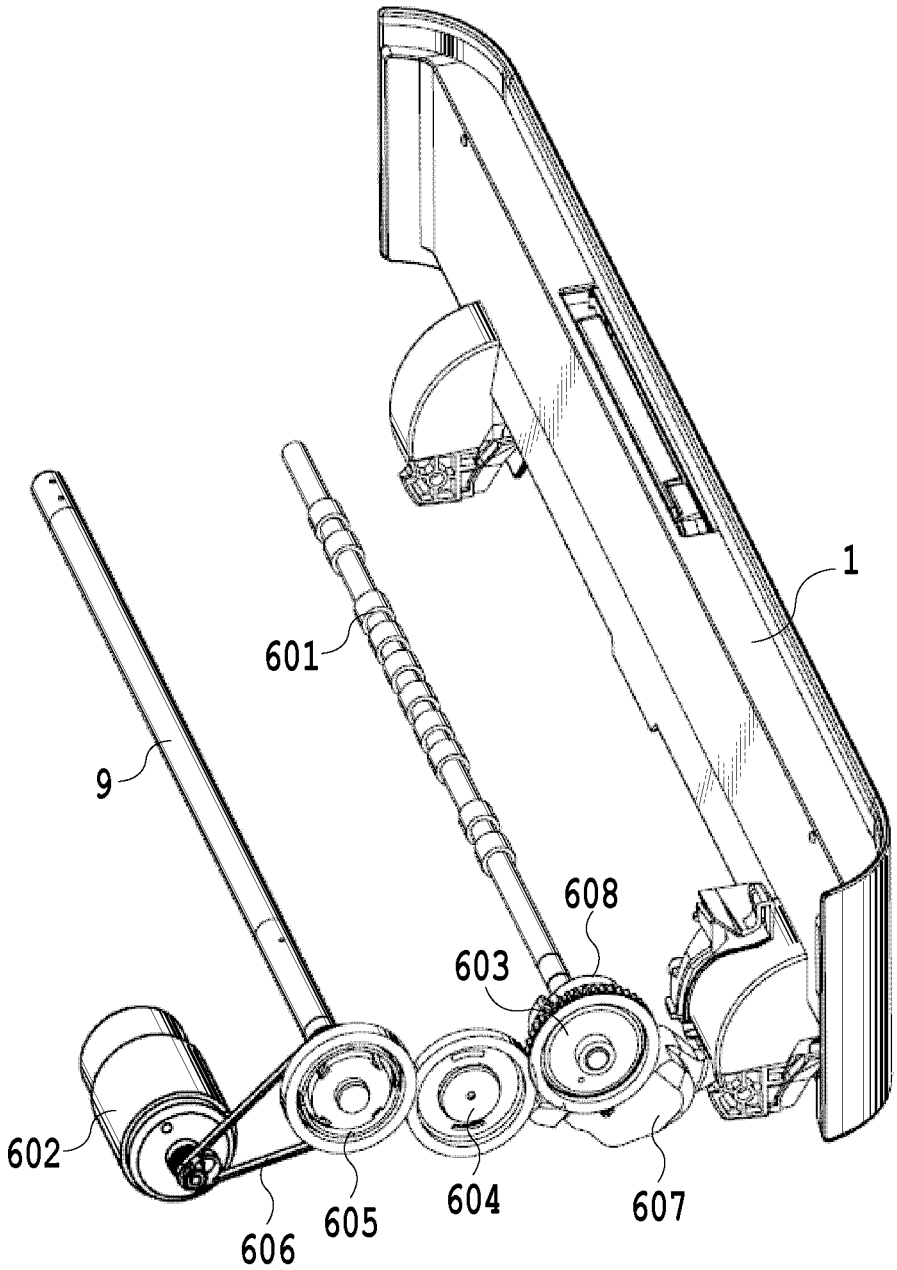
FIG. 4 is a perspective view showing a drive system in a sheet discharge unit.

FIG. 4 is a perspective view showing a drive system of the sheet discharge unit. A drive force is transmitted to a sheet discharge roller 601 from the conveying motor 602 through a conveying roller 9, a sheet discharge roller gear 603, other gears, pulleys 604 and 605, and a belt 606. The sheet discharge roller 601 rotates in a direction of discharging a sheet to the sheet discharge tray 1 as the conveying motor 602 is rotated in a forward direction (rotated in a counterclockwise direction), and rotates in a direction of pulling in the sheet into the main body as the conveying motor 602 is rotated in a backward direction (rotated in a clockwise direction).

The sheet discharge tray 1 is mounted to be capable of opening/closing when it rotates around a rotary shaft provided in a front lower part of the main body in the image forming apparatus P. A rotary lever 607 formed by a combination of link members is provided near the rotary shaft of the sheet discharge tray 1, and the rotary lever 607 and the sheet discharge tray 1 rotate in cooperation.

Figure 5:
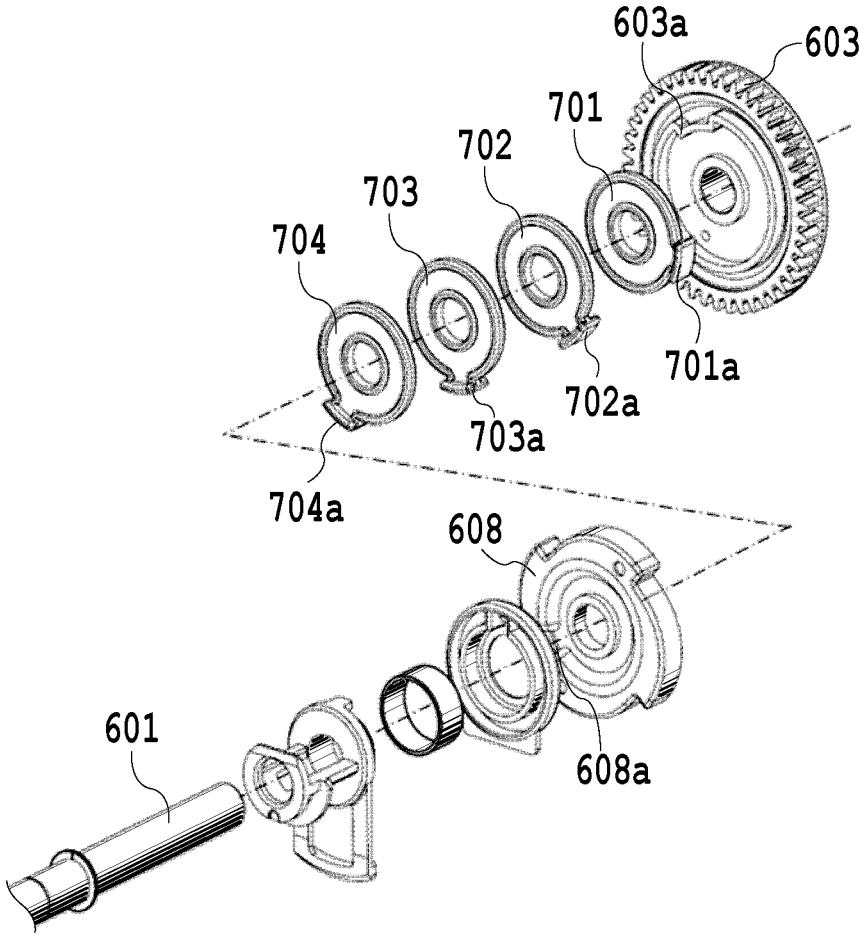
FIG. 5 is a perspective view showing a delay mechanism in the image forming apparatus in the present embodiment.
Figure 6A:
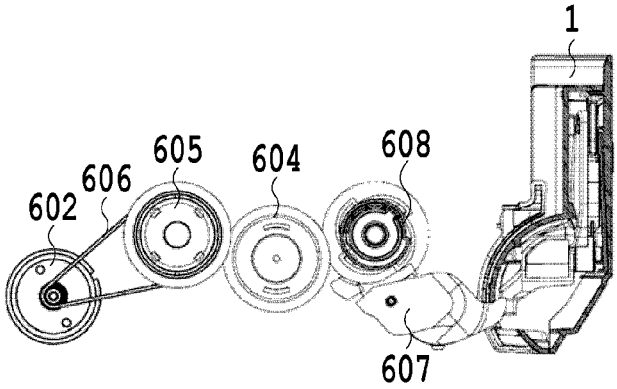
FIG. 6A is across section showing a conveying roller, the delay mechanism, and a sheet discharge tray.
Figure 6B:
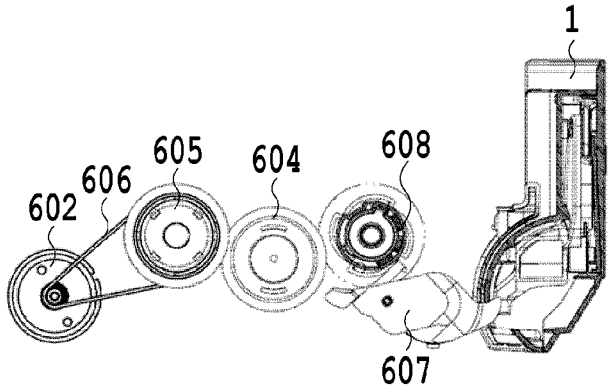
FIG. 6B is a cross section showing the conveying roller, the delay mechanism, and the sheet discharge tray.
Figure 6C:
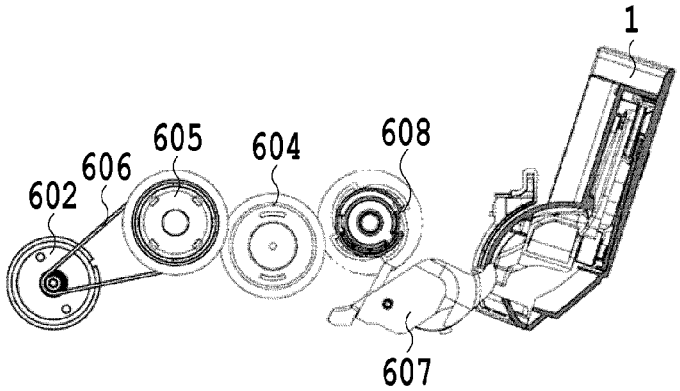
FIG. 6C is a cross section showing the conveying roller, the delay mechanism, and the sheet discharge tray.
Figure 6D:
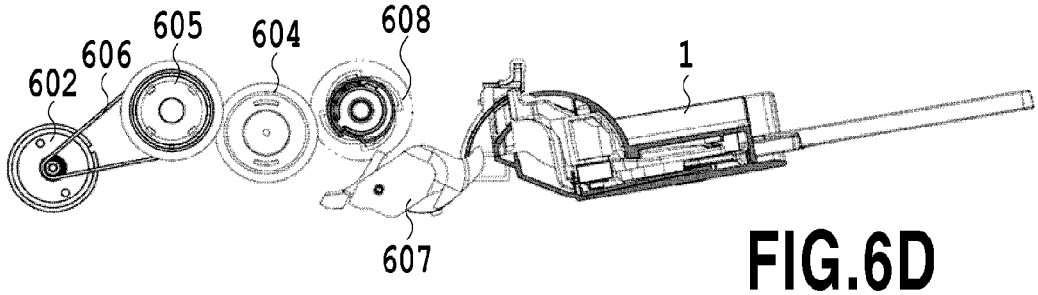
FIG. 6D is a cross section showing the conveying roller, the delay mechanism, and the sheet discharge tray.

FIG. 5 is a perspective view showing a delay mechanism in the image forming mechanism apparatus P in the present embodiment. FIG. 6A to FIG. 6D are cross sections each showing the conveying roller, the delay mechanism, and the sheet discharge tray. A sheet discharge roller cam 608 is mounted coaxially with the conveying roller 601. In a state where the sheet discharge tray 1 is closed, the rotary lever 607 is in contact with the sheet discharge roller cam 608 (FIG. 6A). When the sheet discharge roller cam 608 rotates in a forward direction (rotated in a counterclockwise direction), one end of the rotary lever 607 is pushed downwards, and the reverse end of the rotary lever 607 making contact with the sheet discharge tray 1 moves upwards. As a result, the sheet discharge tray 1 opens (FIG. 6B to FIG. 6D).

On the other hand, in a case where the sheet discharge roller cam 608 rotates in the backward direction (rotated in the counterclockwise direction) in a state where the sheet discharge tray 1 is closed, a force for pushing the rotary lever 607 does not act because of a cam configuration and the sheet discharge tray 1 does not open (FIG. 6B). In addition, since the rotary lever 607 does not make contact with the sheet discharge roller cam 608 in a case where the sheet discharge tray 1 is opened, the sheet discharge roller cam 608 does not cooperate with the rotary lever 607. The drive force is transmitted from the sheet discharge roller 601 to the sheet discharge roller cam 608 through the delay mechanism shown in FIG. 5 and FIG. 7. The explanation of the entire mechanism configuration of the image forming apparatus P is made as described above.

Figure 7:
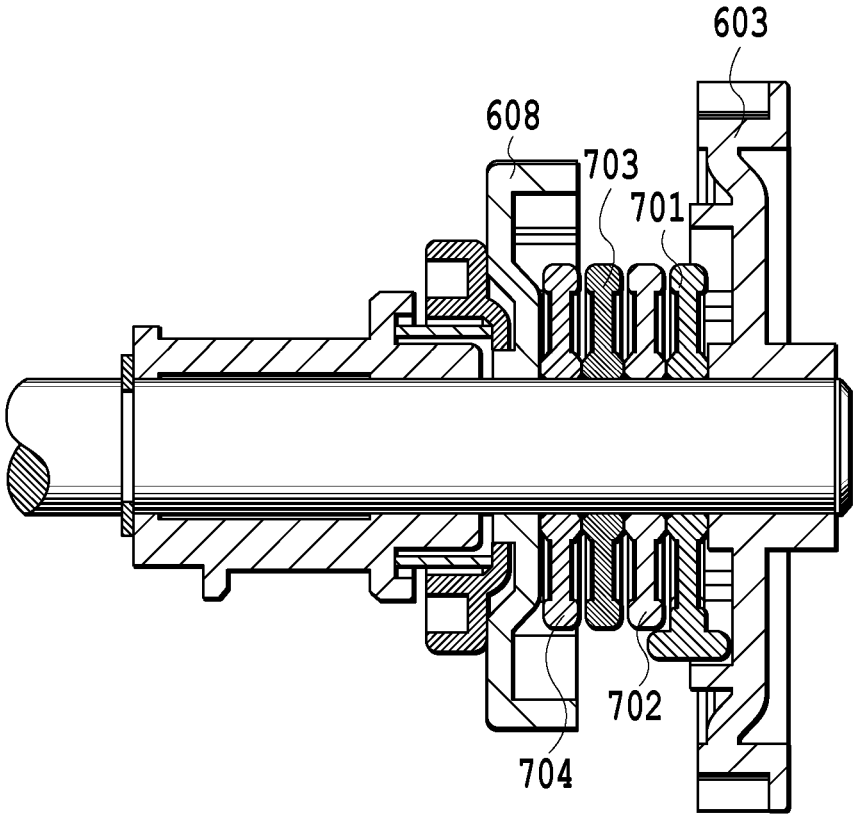
FIG. 7 is a cross section showing a sheet discharge roller, a sheet discharge roller cam, and the delay mechanism.

Next, an explanation will be made of the delay mechanism in the drive transmission from the sheet discharge roller 601 to the sheet discharge roller cam 608. FIG. 7 shows a cross section of the sheet discharge roller 601, the sheet discharge roller cam 608, and the delay mechanism. The delay mechanism is configured of four ring-shaped members 701 to 704 each having one projection, the sheet discharge roller gear 603, and the sheet discharge roller cam 608, which are coaxially with the sheet discharge roller 601. The four ring-shaped members 701 to 704 are called A ring-shaped member 701, B ring-shaped member 702, C ring-shaped member 703, and D ring-shaped member 704 from the order closer to the discharger roller gear 603.

The sheet discharge roller gear 603 plays a role of transmitting the drive from the conveying motor 602 to the sheet discharge roller 601, and is fixed to the sheet discharge roller 601. Therefore the sheet discharge roller gear 603 rotates completely in synchronization with the sheet discharge roller 601. On the other hand, the four ring-shaped members 701 to 704 and the sheet discharge roller cam 608 respectively are slidably and rotatably mounted coaxially with the sheet discharge roller 601 around its axis. The sheet discharge roller gear 603, the ring-shaped members 701 to 704, and the sheet discharge roller cam 608 are configured in such a manner as to be respectively provided with projections that make contact with each other, thereby transmitting the drive therebetween.

Next, an explanation will be made of a system in which a delay is generated by the configuration of the delay mechanism (delay accumulation mechanism) and the delay can be accumulated. When the conveying motor 602 rotates in the forward direction, the sheet discharge roller 601 and the sheet discharge roller gear 603 rotate in the forward direction in synchronization with the conveying motor 602, and a projection 603*a* of the sheet discharge roller gear 603 makes contact with a projection 703*a* of the A ring-shaped member 701 by the time the sheet discharge roller gear 603 performs one rotation.

Thereby the A ring-shaped member 701 and the B ring-shaped member 702 start to rotate in synchronization. Then a projection 701*a* of the A ring-shaped member 701 makes contact with a projection 702*a* of the B ring-shaped member 702 by the time the A ring-shaped member 701 performs one rotation. The A ring-shaped member 701 and the B ring-shaped member 702 start to rotate in synchronization. With continuation of the similar phenomenon, the C ring-shaped member 703 and the D ring-shaped member 704 also rotate in synchronization with the other ring-shaped member and the sheet discharge roller gear 603 by contact of the respective projections 703*a* and 704*a* one after another.

As a result, the projection 704*a* of the D ring-shaped member 704 finally makes contact with the projection 608*a* of the sheet discharge roller cam 608, and the sheet discharge roller 601, the sheet discharge roller gear 603, the respective ring-shaped members 701 to 704 and the sheet discharge roller cam 608 start to rotate in synchronization. In this way, in the drive transmission from the sheet discharge roller 601 to the sheet discharge roller cam 608, there exists a section where the sheet discharge roller 601 moves, but the sheet discharge roller cam 608 does not move until the respective projections make contact with each other to synchronize the drive. This section plays a role of the delay for delaying the transmission of rotation. On the other hand, when the conveying motor 602 rotates in the backward direction, the sheet discharge roller 601 and the sheet discharge roller gear 603 rotate in the backward direction in synchronization with the conveying motor 602.

Then, as similar to the time when the conveying motor 602 rotates in the forward direction, the sheet discharge roller gear 603, the ring-shaped members 701 to 704 and the sheet discharge roller cam 608 are synchronized in order while generating the delay, and finally the sheet discharge roller cam 608 starts with the backward rotation. In a state where the conveying motor 602 is rotated in the backward direction and the sheet discharge roller 601 and the sheet discharge roller cam 608 are synchronized, there is generated the longest rotation section of the conveying roller 9 until the sheet discharge roller 601 and the sheet discharge roller cam 608 are synchronized by next rotating the conveying motor 602 in the forward direction.

That is, the state where the sheet discharge roller 601 and the sheet discharge roller cam 608 are synchronized by rotating the conveying motor 602 in the backward direction is a state where the maximum delay amount to the opening operation of the sheet discharge tray 1 is accumulated. It should be noted that the maximum delay amount is herein set to approximately 247 degrees in the rotation angle of the conveying roller 9. In addition, the delay accumulation mechanism can accumulate any delay amount equal to or less than the maximum amount by rotating the conveying motor 602 in the backward direction. The delay mechanism is as described above.

Figure 8:
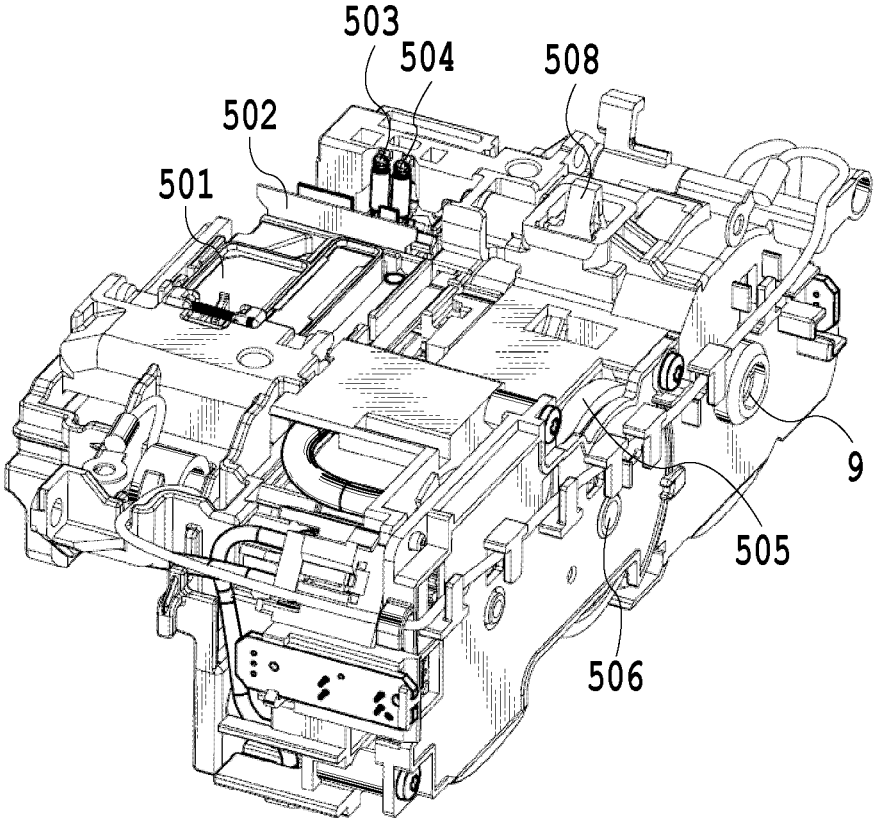
FIG. 8 is a perspective view showing a mechanism of a recovery unit in the image forming apparatus in the present embodiment.

FIG. 8 is a perspective view showing the mechanism of the recovery unit in the image forming apparatus P in the present embodiment. Hereinafter, an explanation will be made of the configuration of the recovery unit. The image forming apparatus P is an inkjet printer, the print head of which has fine ejection openings for ejecting ink. When an ejection opening face on which the ejection openings in the print head are provided is subject to a print or is left in air, ink adheres thereto by drying, bubbles are generated in an ink flow passage, or ink in a mist state adheres thereto to be blots.

For successively performing a good print, it is required that the ink clogging of the ejection opening is eliminated, ink is filled to the vicinity of the ejection opening surface in the ink flow passage, and a recovery operation having a function of wiping the blot on the surface is performed in such a manner that inks of a plurality of colors are not mixed with each other. The recovery operation herein indicates the operation for maintaining the ink ejection opening face of the print head to be in a state suitable for a print as described above (recovering the ejection state), and the general operation sequence associated therewith. For example, the recovery operation includes a wiping operation for wiping the ejection opening face, a cap closing operation, a cap opening operation, an ink suction operation, a head cleaning operation (cleaning processing) made up of a combination thereof, and the like. The image forming apparatus P has the recovery unit for controlling the recovery operation.

The recovery unit includes a cap 501 attached to the print head to protect the ink ejection opening face in the print head from drying, a wiper 502 for wiping the ink ejection opening face in the print head, and a carriage lock pin 508 inserted into the carriage to fix the recovery unit. The recovery unit further includes a pump unit 505 connected through a color ink valve 503 and a black ink valve 504 to the cap 501 to suck ink, and the like.

The pump 505 is made of a tube pump, and pushes a roller to the tube to rotate a pump roller, thus performing the suction. A drive of the recovery unit is transmitted by the conveying roller 9 through a revolver mechanism provided next to the recovery unit. The revolver mechanism can switch an on-state and an off-state by pressing the carriage on a clutch. In a clutch-on state, the drive from the conveying roller 9 to the recovery unit is cut off. In a clutch-off state, the drive from the conveying roller 9 to the recovery unit is transmitted.

When the conveying roller 9 rotates in the backward direction in the clutch-off state, the pump roller 506 rotates in the forward direction in association with it to suck ink from the cap 501. In addition, when the conveying roller 9 rotates in the forward direction, the pump roller 506 rotates in the backward direction in association with it, and at the same time a recovery cam (not shown) rotates in the forward direction. When the pump roller 506 rotates in the backward direction, a press-contact state of the roller to the pump tube is released. By performing the conveying roller 9 by one rotation in the forward direction, the press-contact state of the pump tube is completely released to perform initialization of the pump.

On the other hand, the recovery cam is installed coaxially with the conveying roller 9. When the recovery cam rotates in the forward direction, the opening/closing operation of the color ink valve 503 and the black ink valve 504, a descending operation of the carriage lock pin 508, a descending operation of the cap 501, a reciprocal operation of the wiper 502, a rising operation of the carriage lock pin 508 and a rising operation of the cap 501 are performed during one rotation thereof. It should be noted that the recovery cam does not drive at the backward rotation of the conveying roller 9.

According to the above-mentioned configuration, the recovery unit can be controlled by the conveying motor 602 controlled by the control unit, but on the other hand, the conveying roller 9 and the sheet discharge roller 601 move in association also at the driving of the recovery unit. The configuration of the recovery unit is as explained above. It should be noted that as described above, when the drive transmission to the recovery unit is cut off by the revolving mechanism, it is possible to drive the conveying roller 9 and the sheet discharge roller 601 with no association of the recovery unit. That is, by rotating the conveying motor 602 in the backward direction after cutting off the drive transmission to the recovery unit, it is possible to accumulate the delay for opening operation prevention of the sheet discharge tray 1 without driving the recovery unit.

Next, an explanation will be in detail made of the delay accumulation control for accumulating a delay amount of opening operation prevention of the sheet discharge tray 1. In the drive of each drive unit and execution of the operation sequence, a CPU 1103 loads programs and parameter data stored in a ROM 1101 and develops them on a RAM 1102 to control each unit based upon the program and the parameter data. As described above, as the recovery unit is operated, since the sheet discharge roller 601 rotates associated therewith, there are some cases where the sheet discharge tray 1 opens in association with the sheet discharge roller 601.

The event that the sheet discharge tray 1 inadvertently opens during the operation not accompanied by the sheet discharging is usually not preferable in view of usability. Therefore in a series of operations of the operation sequence in the recovery unit, in a case of rotating the conveying roller 9 at an angle equal to or more than a sum of 247 degrees in the forward direction, the delay accumulation sequence is executed in between the respective operations. For example, an example of executing the delay accumulation sequence includes a cap closing sequence. The cap closing sequence performs a series of operations made up of wiping the ink ejection opening face of the print head to eliminate the blot, further sucking waste ink reserved in the cap 501 by the pump 505, and thereafter, pushing up the cap 501 to cap the print head.

The wiping operation performed at this time is sequence for rotating the recovery cam in the forward direction by a sum of 360 degrees. After the suction by the pump 505, the backward rotation operation of the pump roller 506 is performed for releasing the press-contact state of the roller. It is required to rotate the conveying roller 9 in the forward direction by 360 degrees in this operation. Accordingly, since the conveying roller 9 is rotated in the forward direction by 247 degrees or more, it is necessary to execute the delay accumulation sequence in the halfway between the wiping operation and the forward rotation operation of the pump roller 506 for preventing the sheet discharge tray 1 from inadvertently opening.

Figure 9:
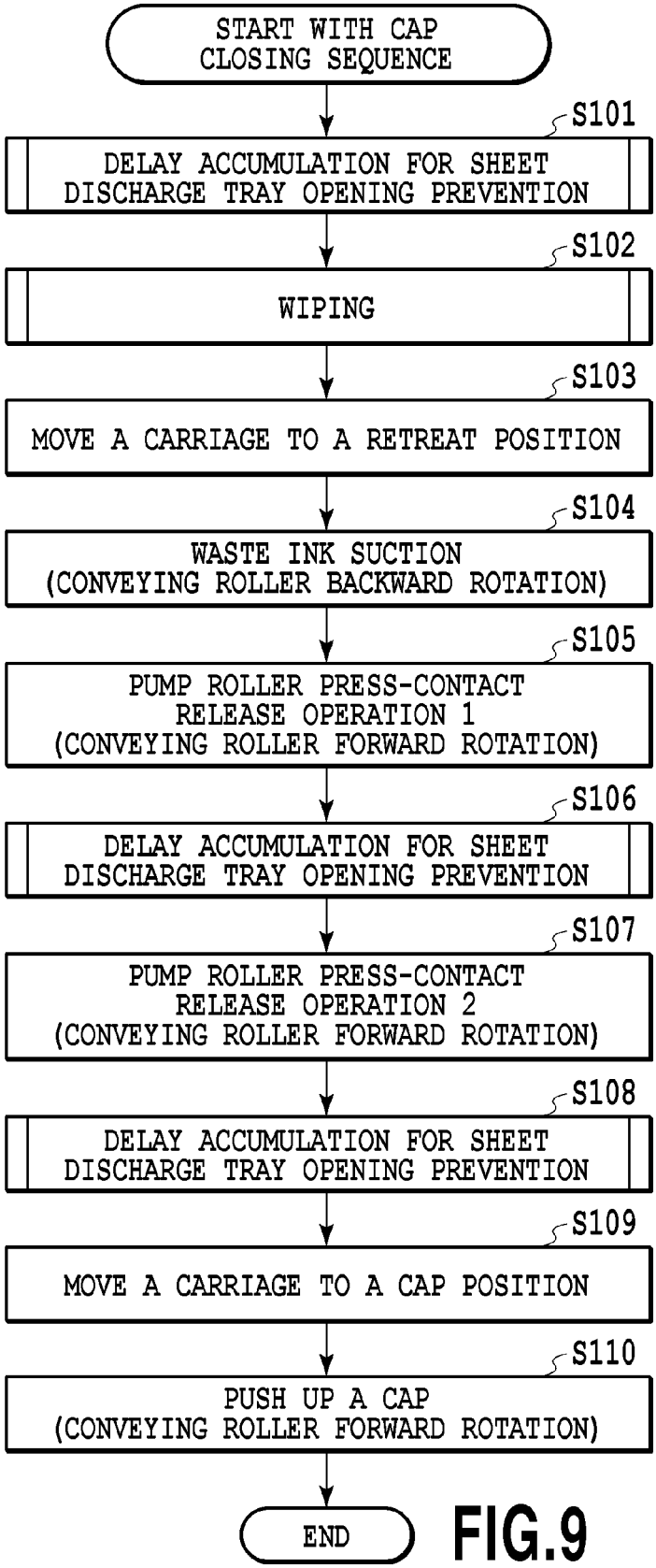
FIG. 9 is a flow chart showing cap closing sequence.
Figure 10:
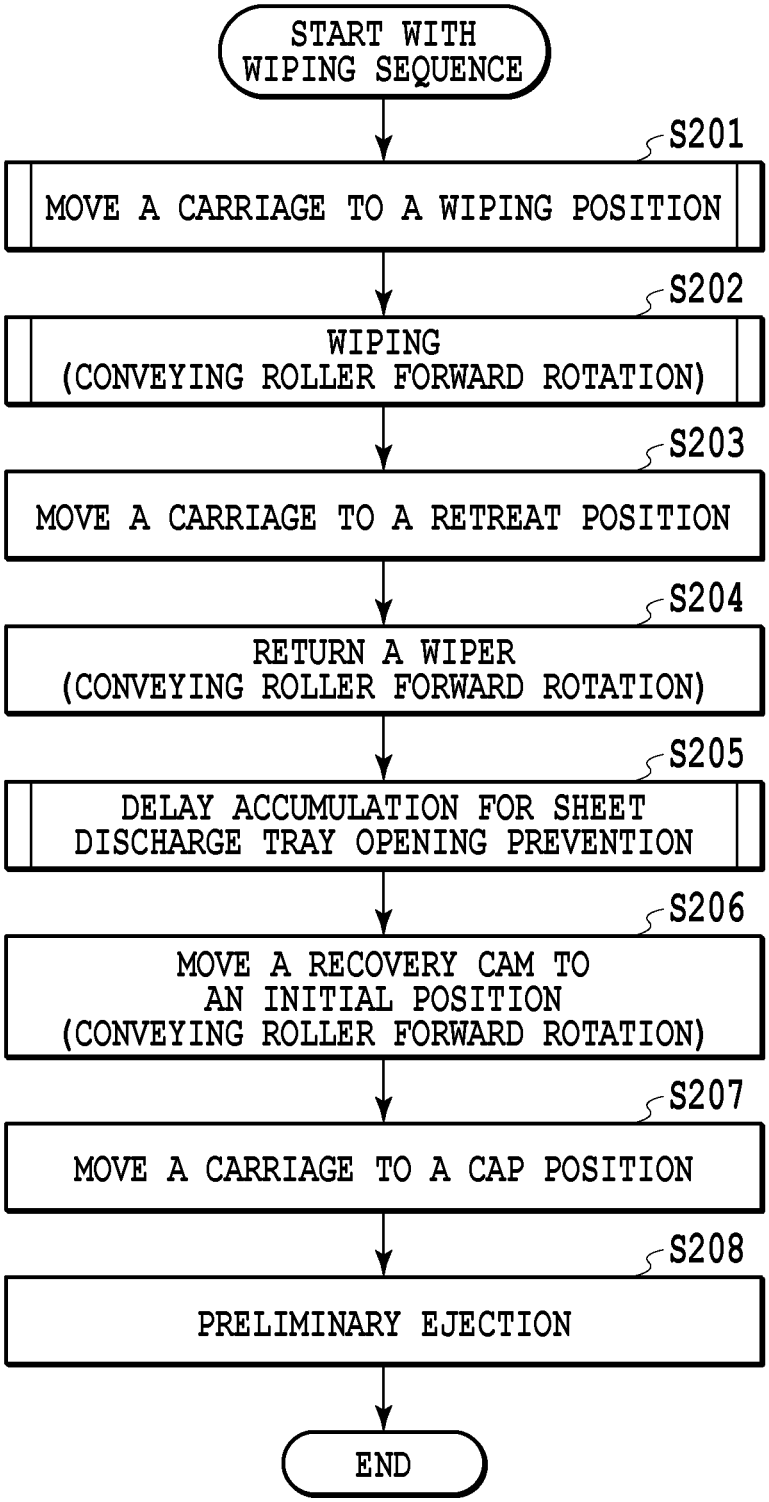
FIG. 10 is a flow chart showing sequence of a wiping operation.

FIG. 9 is a flow chart showing the cap closing sequence, and FIG. 10 is a flow chart showing the sequence of the wiping. The CPU 1103 executes the sequence of the cap closing and the sequence of the wiping according to the flow charts shown in FIG. 9 and FIG. 10. Hereinafter an explanation will be made of the cap closing sequence along the flow chart in FIG. 9. When the cap closing sequence is started, at step S101 a delay accumulation operation is first performed, and then at step S102 a wiping operation is performed. It should be noted that the detailed sequence of each of the delay accumulation operation and the wiping operation will be described later.

After the wiping, at step S103 the carriage is moved to a retreat position. The retreat position herein means a position where the print head is set to deviate from on the cap 501. After that, in the waste ink suction operation at step S104, the waste ink reserved in the cap 501 is discharged by the pump 505. Since the conveying roller 9 is sufficiently rotated in the backward direction in this operation, the delay for the opening operation prevention of the sheet discharge tray is simultaneously accumulated to the maximum amount.

After that, at step S105 the conveying roller 9 is rotated by approximately 150 degrees in the forward direction, and subsequently at step S106 the delay accumulation is performed, and after that, at step S107 the conveying roller 9 rotates by the rest of approximately 210 degrees in the forward direction. The process of each at step S105 and step S107 is the backward rotation operation of the pump roller 506 that is performed for releasing the press-contact state of the roller of the pump. Here, since the accumulated delay is mostly consumed in the operation at step S107, the delay accumulation is again performed at step S108 in preparation for the next forward rotation operation of the conveying roller 9.

At next step S109 the carriage is moved in such a manner that the print head comes on the cap 501. In addition, by rotating the conveying roller 9 in the forward direction at step S110, the recovery cam is driven to push up the cap 501 to the print head. In this way, the capping of the print head is performed and a series of processes in the cap closing sequence end.

Hereinafter the wiping sequence will be explained along the flow chart in FIG. 10. When the wiping sequence is started, first at step S201 the carriage is moved to a wiping position. Herein the wiping position is a position where the ink ejection opening face of the print head can be wiped by the wiper 502, and is the same as the cap position in the image forming apparatus P in the present embodiment.

Next, at step S202 the ejection opening face of the print head is wiped in one direction by the wiper 502. This operation is performed by the forward rotation of the recovery cam by the forward rotation of the conveying roller 9. Next, after at step S203 the carriage is moved to the retreat position, at step S204 the conveying roller 9 is again rotated in the forward direction to drive the recovery cam, and the wiper 502 is back to the original position. The primary reason for performing this sequence is that when the print head surface is wiped in the backward direction by the wiper 502, the effect of the ink wiping cannot be obtained sufficiently.

It should be noted that in a series of the operations of step S201 to step S204, the conveying roller 9 is rotated in the forward direction by a sum of approximately 150 degrees. At step S205 the accumulation of the delay is performed, and at step S206 for moving the recovery cam to an initial position, the conveying roller 9 is rotated in the forward direction by 210 degrees. Therefore at step S205 the delay accumulation sequence for the opening operation prevention of the sheet discharge tray is performed. After that, at step S207 the carriage is moved to the cap position, and at step S208, for making the state of the print head in a good condition, a preliminary ejection for ejecting ink that does not contribute to the print is performed. The above-mentioned process is a flow of the operations in the cap closing sequence including the wiping sequence.

The cap closing is an operation primarily for preventing the ink ejection opening face of the print head from drying, and is one of basic recovery operations of an inkjet printer. Therefore the cap closing sequence is regularly provided as an API (Application Program Interface), and is executed in various steps during the operation of the apparatus.

For example, the cap closing sequence is performed in a case where a predetermined time elapses without printing in the cap opening state, at an operation time associated with a power-off process of the apparatus main body, at a cleaning operation time of the print head, and the like. When a predetermined time elapses without printing in the cap opening state, a predetermined time release process is executed. The predetermined time release process is an operation having an object of setting the print head in a waiting state for preventing the ink ejection opening face of the print head from drying based upon the determination of the CPU 1103 that a user will not print for the time being.

The power-off process of the apparatus main body is a process to be executed based upon the estimation that a user has finished use of the image forming apparatus P, and performs an capping operation on the print head for preventing the ink ejection opening face of the print head from drying by the time the image forming apparatus P is activated next time. In addition, necessary information is stored in the ROM 1101, and finally the power source supplied to the image forming apparatus P is cut off. That is, in a case where the sheet discharge tray 1 is closed by a user before the cap closing operation at the time a predetermined time elapses without printing or the cap closing operation at the operation associated with the power-off process of the apparatus main body, it is not preferable that the sheet discharge tray 1 inadvertently opens during the operation.

Therefore for preventing the sheet discharge tray 1 from opening, it is required to certainly perform the delay accumulation at step S101, at step S106 and step S108 in FIG. 9, and at step S205 in FIG. 10. On the other hand, the cleaning operation of the print head is basically an operation that is performed at timing immediately before printing on a print medium. The cleaning operation includes capping the print head, controlling the valves 503 and 504, and the pump 505 for suction, filling ink in the ink flow passage of the print head, eliminating the ink clogging of the ink ejection opening face, and wiping blots of the ejection opening face by the wiper 502.

This operation makes the state of the print head in a good condition before starting the print. Since the sheet discharging is performed together with the printing on the print medium, it is preferable that the sheet discharge tray is opened. That is, in the cap closing operation that is performed at the cleaning operation of the print head, even if the closed sheet discharge tray 1 opens, it is not inconvenient for a user. Further, since the cleaning operation time is a part of a waiting time for a user until the print outcome is obtained, it is desirable that it is completed for a short time.

In addition, the wiping sequence is also one of the basic recovery operations, and is executed in various steps as the API. For example, in a case of the cap closing or successive printing of a plurality of pages, the wiping sequence is executed for each one page for maintaining the surface of the print head to be in a good condition. Also in the wiping sequence, in the cap closing operation at the time a predetermined time elapses without printing in the cap opening state or in the cap closing operation at the operation associated with the power-off process of the apparatus main body, it is necessary to prevent the sheet discharge tray 1 from inadvertently opening. On the other hand, in the recovery operation that is performed for each page at the printing of the plural pages, it has no problem that the sheet discharge tray 1 opens, and it is preferable to shorten the operation time also in view of throughput improvement.

Figure 11:
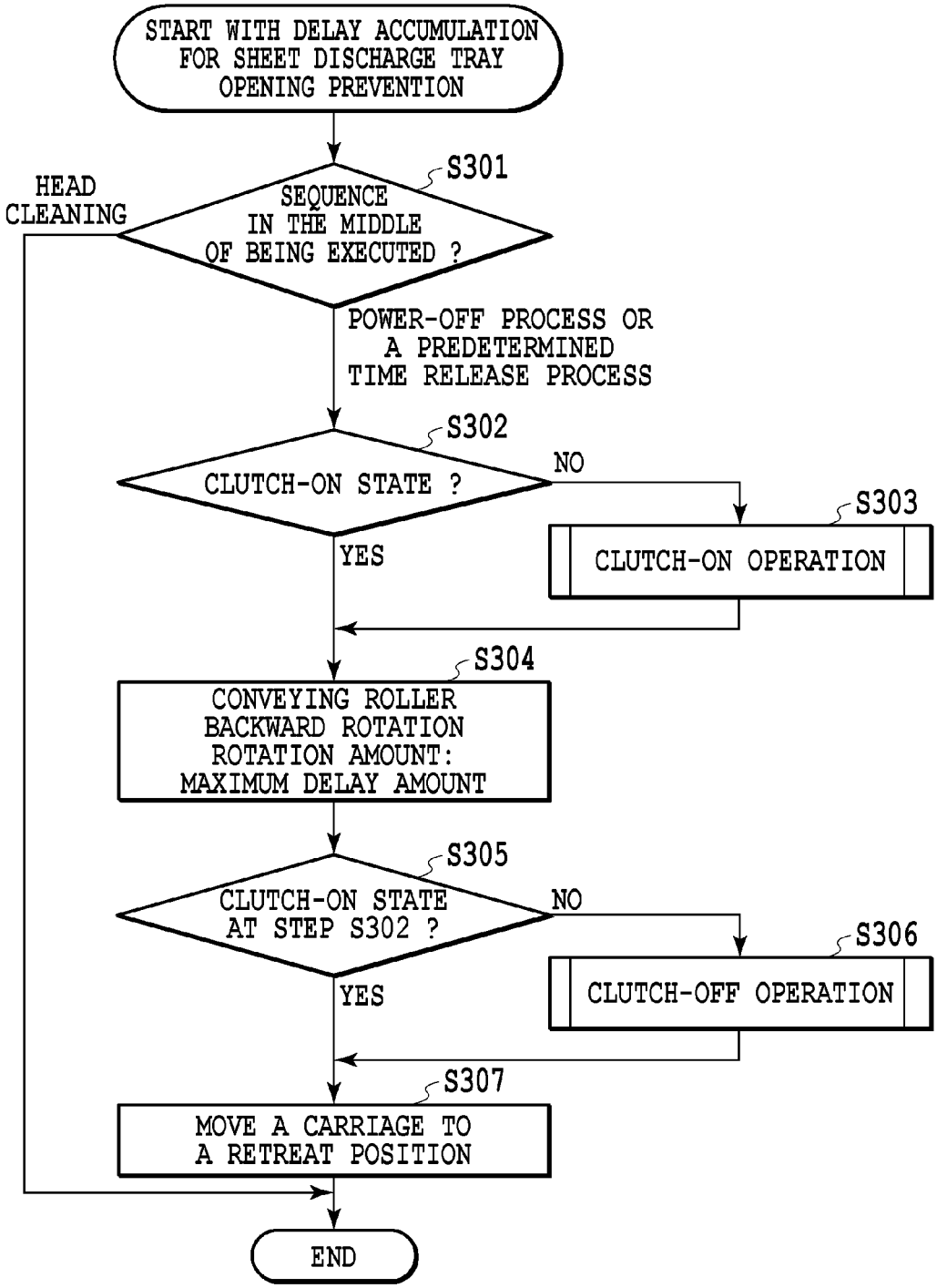
FIG. 11 is a flow chart showing delay accumulation sequence for sheet discharge tray opening prevention.

FIG. 11 is a flow chart showing the delay accumulation sequence for the opening operation prevention of the sheet discharge tray. The delay accumulation operation for the opening operation prevention of the sheet discharge tray is performed by the sequence shown in FIG. 11. As a precondition thereof, the program for controlling the image forming apparatus P determines the sequence to be executed using events such as an elapse time, a user's operation, and reception of a print job from outside as triggers, and information of the sequence in the middle of being executed at present is stored in the RAM 1102. An explanation will be made of the sequence of the delay accumulation operation for the opening operation prevention of the sheet discharge tray along the flow chart in FIG. 11.

When the delay accumulation operation for the opening operation prevention of the sheet discharge tray is started, at step S301 the CPU 1103 determines whether the sequence is call-out in the cap closing at the operating associated with the power-off process, call-out in the cap closing at a predetermined time release process or call-out in the cap closing at the cleaning operation. By referring to the RAM 1102, information of the sequence in the middle of being executed at present is obtained, and this determination is made based upon the obtained information. In a case where it is determined that the power-off process or the predetermined time release process is in the middle of being executed, the process goes to step S302, wherein a state of the clutch connecting the drive from the conveying roller 9 to the recovery unit is determined.

The determination result at this time is stored in the RAM 1102. In a case where the clutch is not in an on-state, at step S303 the clutch is made to be in an on-state, and the drive transmission from the conveying roller 9 to the recovery unit is cut off. In addition, in a state where the drive of the recovery unit is cut off, at step S304 the conveying roller 9 is rotated in the backward direction to accumulate the delay for the opening operation prevention of the sheet discharge tray. The rotation amount at this time is equal to the amount for rotating the conveying roller 9 by approximately 247 degrees, and the maximum delay amount can be certainly accumulated.

After performing the delay accumulation, at step S305 by referring to the RAM 1102, it is determined whether or not the clutch was in an on-state at step S302. In addition, in a case where the clutch was in the off-state, at step S306 the clutch is again back to the off-state, and finally at step S307 the carriage is moved to the retreat position to end the flow chart. On the other hand, in a case where at step S301 it is determined that the sequence is the cleaning operation time, the flow chart ends without performing any operation after that.

In the image forming apparatus P in the present embodiment, a total time required for the clutch-on operation at step S303, for the conveying roller backward rotation operation at step S304, for the clutch off-operation of the at step S306, and for the carriage operation at step S307 is approximately 6 seconds. In the cap closing sequence, since the delay accumulation operation for the opening operation prevention of the sheet discharge tray including the wiping sequence is performed four times, there is a time difference of approximately 24 seconds between a case where an actual operation of the delay accumulation is executed during the cap closing and a case where the actual operation of the delay accumulation is not executed during the cap closing.

In this way, it is determined whether or not the delay accumulation operation is necessary at the time of performing the cap closing operation or the wiping operation, and in a case where it is necessary, the delay accumulation operation is performed. Thereby the sheet discharge tray opening operation is prevented by accumulating the delay at timing where the sheet discharge tray should not open, and at timing where there is no problem even if the sheet discharge tray opens, the delay is not accumulated, thus making it possible to shorten the operation time.

Second Embodiment

Hereinafter a second embodiment in the present invention will be explained with reference to the drawing. It should be noted that since a basic configuration of the present embodiment is the same as that of the first embodiment, hereinafter a characteristic configuration only will be explained.

Figure 12:
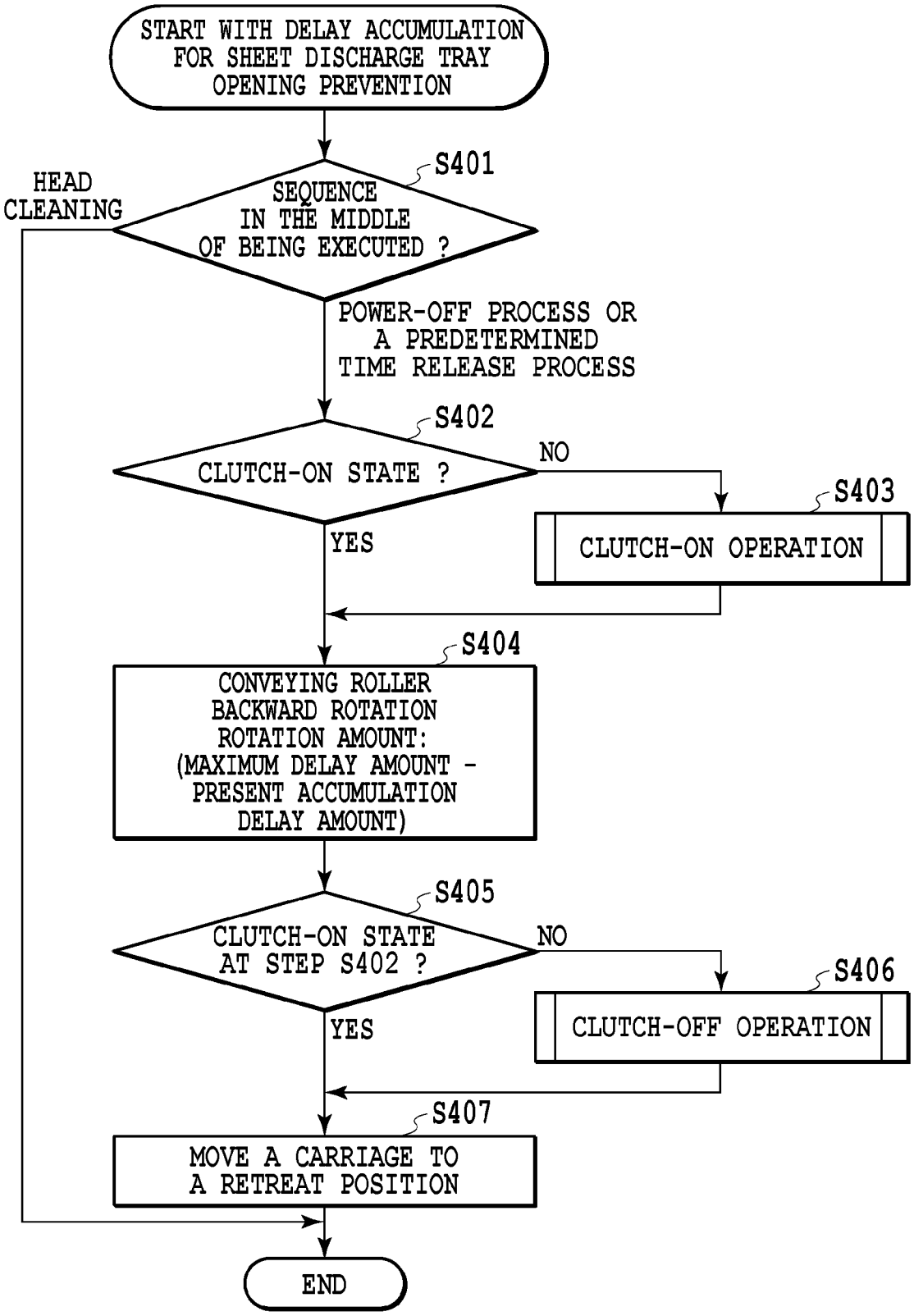
FIG. 12 is a flow chart showing the delay accumulation sequence for the sheet discharge tray opening prevention.

FIG. 12 is a flow chart showing the delay accumulation sequence for the opening operation prevention of the sheet discharge tray. In the image forming apparatus P that has the same mechanism as the first embodiment, the CPU 1103 executes the cap closing sequence shown in FIG. 9 as similar to the first embodiment. In this case, the delay accumulation operation for the opening operation prevention of the sheet discharge tray that is performed at the cap closing sequence is executed according to the flow chart in FIG. 12.

Hereinafter an explanation will be made of the delay accumulation sequence for the opening operation prevention of the sheet discharge tray in the present embodiment along the flow chart in FIG. 12. When the sequence is started, at step S401 it is determined based upon information in the RAM 1102 whether the sequence is call-out in the cap closing at the operating associated with the power-off process, call-out in the cap closing at a predetermined time release process or call-out in the cap closing at the cleaning operation.

In a case where it is determined that the power-off process or the predetermined time release process is in the middle of being executed, the process goes to step S402, wherein a state of the clutch connecting the drive from the conveying roller 9 to the recovery unit is determined. The determination result at this time is stored in the RAM 1102. In a case where the clutch is not in an on-state, at step S403 the clutch is made to be in an on-state, and the drive transmission from the conveying roller 9 to the recovery unit is cut off. In addition, in a state where the drive of the recovery unit is cut off, at step S404 the conveying roller 9 is rotated in the backward direction to accumulate the delay for the opening operation prevention of the sheet discharge tray.

The rotation amount at this time is a value found by subtracting the presently accumulated delay amount from the maximum delay amount that can be accumulated in the delay mechanism of the conveying roller 9. That is, the conveying roller 9 is rotated by a rotation amount necessary for the maximum delay amount by the operation at step S404, and thereby the maximum delay amount is accumulated. After performing the delay accumulation, at step S405 by referring to the RAM 1102, it is determined whether or not the clutch was in an on-state at a point of step S402.

In addition, in a case where the clutch was in the off-state, at step S406 the clutch is again back to the off-state, and finally at step S407 the carriage is moved to the retreat position to end the flow chart. On the other hand, in a case where it is determined at step S401 that the sequence is the cleaning operation time, the flow chart ends without performing any subsequent operation to end the flow chart. By controlling the delay accumulation with this method, it is possible to shorten the time for the delay accumulation operation more than in the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-202615, filed Sep. 14, 2012, which is hereby incorporated by reference herein in its entirety.

What is claimed is:

1. An image forming apparatus comprising:

a print head for performing a print on a print medium;

a sheet discharge unit configured to discharge the print medium to a sheet discharge tray with rotation of a sheet discharge roller;

a recovery unit configured to perform a recovery operation of the print head;

a delay accumulation mechanism for accumulating a delay amount by a delay accumulation operation with a backward rotation of the sheet discharge roller; and a determining unit configured to determine whether the delay accumulation operation is performed, wherein in the delay accumulation operation the sheet discharge tray is opened by rotating the sheet discharge roller in a forward direction exceeding the delay amount accumulated in the delay accumulation mechanism, wherein in a case where the determining unit determines that the delay accumulation operation is performed, the delay accumulation operation is performed at the time the recovery unit performs the recovery operation.

2. An image forming apparatus according to claim 1, wherein a delay amount found by subtracting the delay amount accumulated in the delay accumulation mechanism from the maximum delay amount that can be accumulated in the delay accumulation mechanism is accumulated by the delay accumulation operation, and thereby the opening operation of the sheet discharge tray is controlled not to be performed.

3. An image forming apparatus according to claim 1, wherein the delay accumulation operation is performed in a case of performing discharge of the print medium at the time the recovery operation of the recovery unit is completed.

4. An image forming apparatus according to claim 1, wherein the determining unit, in a case where a power-off process of cutting off a power source in the image forming apparatus is in the middle of being executed or a release-time process in which the image forming apparatus is released for a predetermined time is in the middle of being executed, determines to perform the delay accumulation operation, and in a case where a cleaning process for executing cleaning of the print head is in the middle of being executed, determines not to perform the delay accumulation operation.

* * * * *